US006050793A

United States Patent [19]

Barthod et al.

[11] Patent Number: 6,050,793

[45] Date of Patent: Apr. 18, 2000

[54] SCROLL TYPE FLUID DISPLACEMENT MACHINE

[75] Inventors: Benoît Barthod, Naves-Parmelan; Jean-Pierre Chicherie, deceased, late of Annecy-Le-Vieux, by Mireille Chicherie, legal representative; Patrick Philippe, Annecy, all of France

[73] Assignee: Alcatel, Paris, France

[21] Appl. No.: 09/090,159

[22] Filed: Jun. 4, 1998

[30] Foreign Application Priority Data

Jun. 5, 1997 [FR] France ..... 97 06966

[51] Int. Cl.[7] ..... F01C 1/02

[52] U.S. Cl. ..... 418/55.1; 418/108; 418/188

[58] Field of Search ..... 418/55.1, 188, 418/108

[56] References Cited

U.S. PATENT DOCUMENTS

| | | | |
|---|---|---|---|
| 4,383,805 | 5/1983 | Teegarden et al. | 418/55.1 X |
| 4,677,949 | 7/1987 | Youtie . | |
| 5,167,494 | 12/1992 | Inagaki et al. . | |
| 5,354,184 | 10/1994 | Forni | 418/55.1 X |
| 5,503,539 | 4/1996 | Nakajima et al. | 418/55.1 |

FOREIGN PATENT DOCUMENTS

| | | |
|---|---|---|
| 1210922 | 3/1960 | France . |
| 2141402 | 1/1973 | France . |
| 2225327 | 12/1972 | Germany . |

*Primary Examiner*—Hoang Nguyen
*Attorney, Agent, or Firm*—Sughrue, Mion, Zinn, Macpeak & Seas, PLLC

[57] ABSTRACT

The machine includes a fixed disk (2) comprising a spiral wall (3), a mobile disk (4) also comprising a spiral wall (5) cooperating with that of the fixed disk, and means (11, 16, 22, 23) for driving circular translation movement of the mobile disk, the mobile disk being positioned axially by a system including a shoe (25, 32, 36) rubbing between two lateral abutments (26, 27–34, 35–39, 40), one member of the pair of members (i.e. the shoe or the lateral abutments, being attached to a fixed frame (1) and the other member of this pair of members being fastened to the mobile disk (4), characterized in that the fixed disk (2) is joined on the side opposite the mobile disk (4) to a fixed central shaft (7) joined to the frame (1) and including a discharge passage (8), the central shaft (7) being surrounded by a sealing bellows (12) connected at one end to the frame and at its other end to a connecting flange (10, 10A) the periphery of which, around the fixed disk (2), is joined to the mobile disk (4) beyond its spiral wall (5), the mobile disk (4) and the flange (10, 10A) forming a casing enclosing the fixed disk (2), the space (13) between the bellows (12) and the central shaft (7) constituting a suction passage, and in that the mobile disk axial positioning system is external of the internal volume of the casing (4–10, 10A), the member attached to the mobile disk, i.e. the shoe or the lateral abutments, being attached to the casing and projecting externally of it.

1 Claim, 3 Drawing Sheets

SCROLL TYPE FLUID DISPLACEMENT MACHINE

The present invention concerns a scroll type fluid displacement machine including a fixed disk comprising a spiral working wall, a mobile disk also comprising a spiral working wall cooperating with that of the fixed disk and means for driving circular translation movement of the mobile disk, the mobile disk being positioned axially by a system including a shoe rubbing between two lateral abutments, one member of the pair of members (i.e. the shoe or the lateral abutments, being fastened to a fixed frame and the other member of this pair of members being fastened to said mobile disk.

U.S. Pat. No. 5,167,494 describes a machine of the above kind but the system for positioning the mobile disk axially and the mechanical components such as the bearing and the movement conversion interface are not isolated from the pumping circuit which means that a machine of the above kind cannot be used as a clean vacuum pump. Moreover, adjusting the axial position appears to be difficult.

An aim of the present invention is to alleviate these drawbacks and the present invention consists in a machine as defined hereinabove characterized in that the fixed disk is joined on the side opposite the mobile disk to a fixed central shaft joined to the frame and including a discharge passage, said central shaft being surrounded by a sealing bellows joined at one end to the frame and at its other end to a connecting flange the periphery of which, around the fixed disk, is joined to the mobile disk beyond its spiral wall, the mobile disk and the flange forming a casing enclosing the fixed disk, the space between the bellows and said central shaft constituting a suction passage, and in that said mobile disk axial positioning system is external of the internal volume of said casing, said member attached to the mobile disk, i.e. the shoe or the lateral abutments, being attached to said casing and projecting externally of it.

One embodiment of the invention will now be described with reference to the accompanying drawings, in which.

Figure 3:
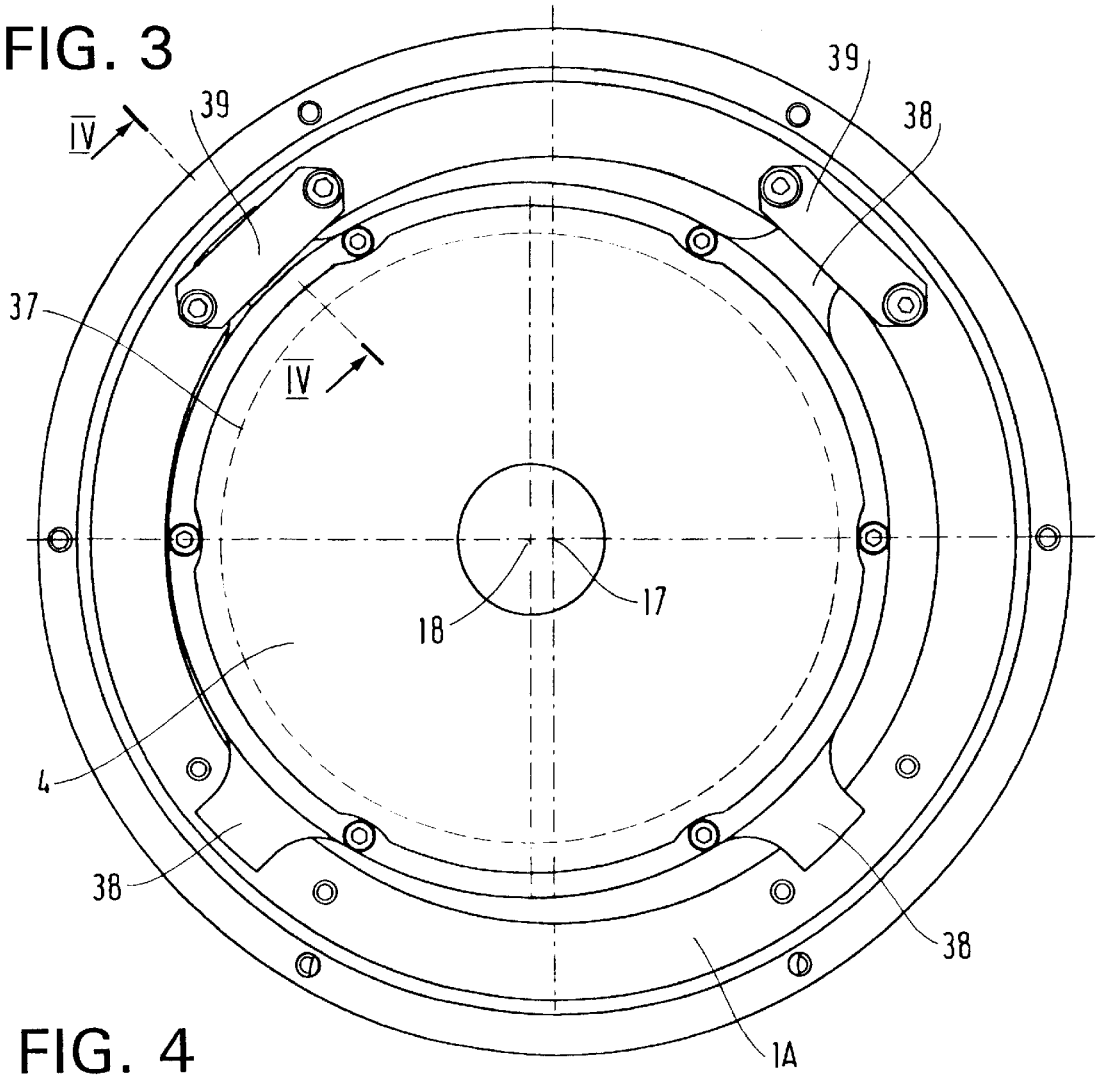
FIGS. 3, 4 and 5 represent a variant of FIG. 2 in which the shoe, also joined to the mobile disk, is in the form of a washer-disk with four rubbing members in a cruciform arrangement and the lateral abutments, joined to the frame, are in the form of strips.

In these figures, FIG. 3 shows the machine end-on, from the mobile disk side with the casing removed.

Figure 4:
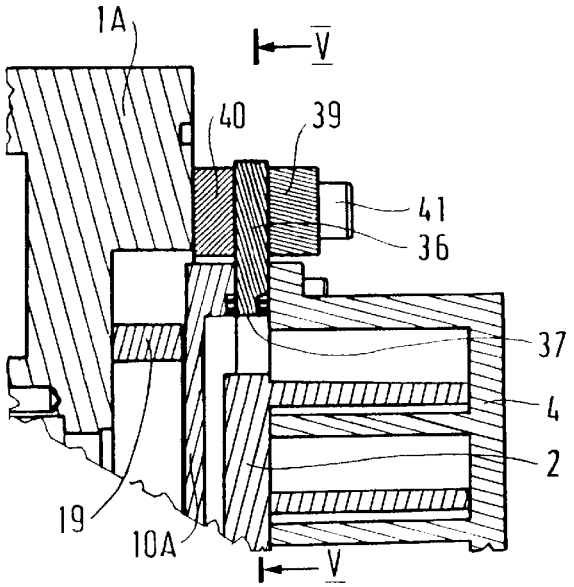
Figure 5:
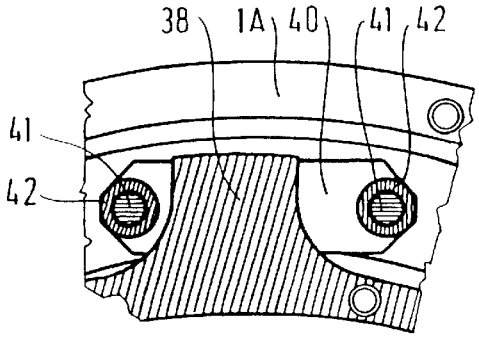

FIG. 4 is a part sectional view taken along the line IV—IV in FIG. 3 and FIG. 5 is a part sectional view taken along the line V—V in FIG. 4.

Figure 1:
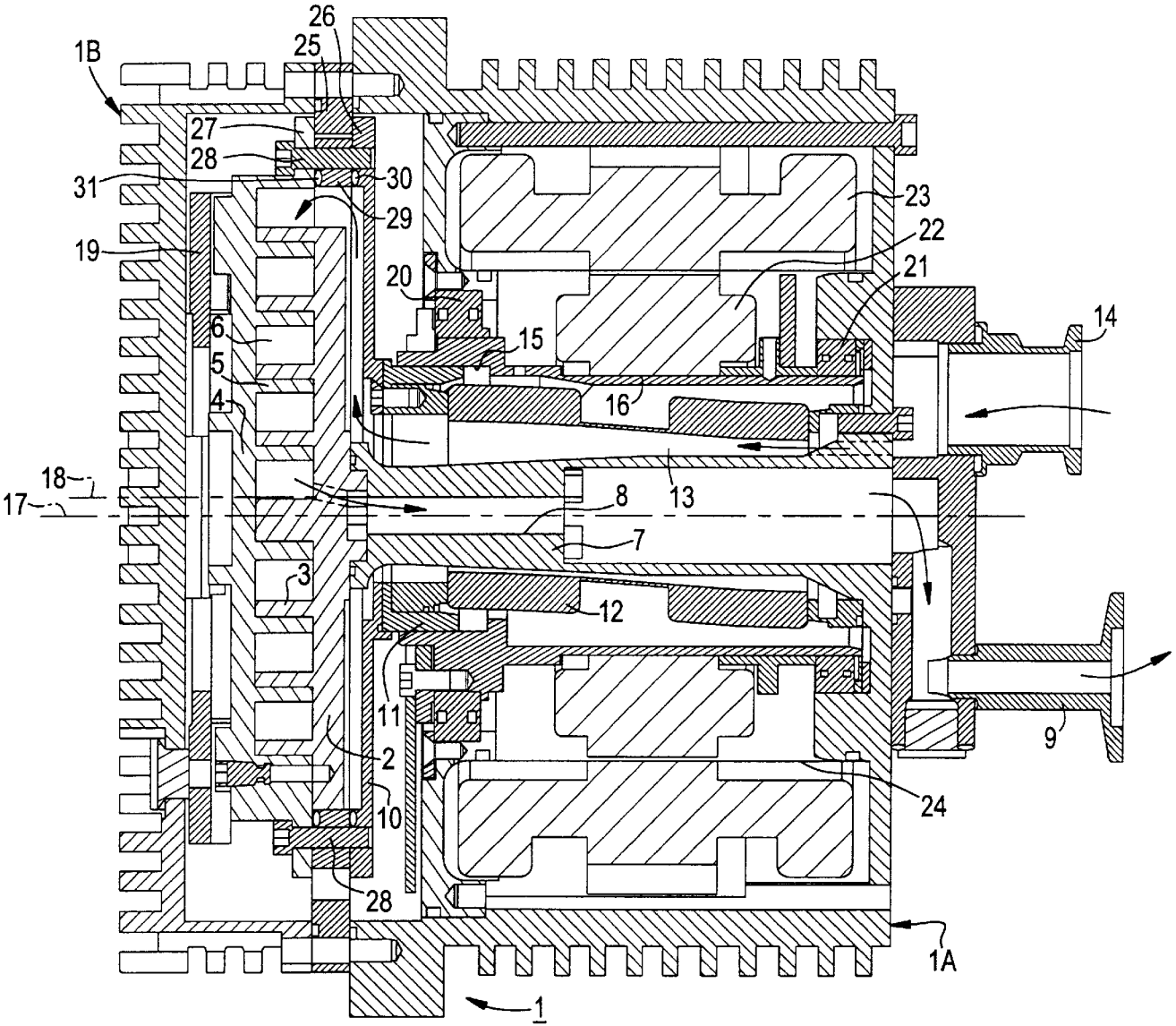
FIG. 1 shows a scroll type fluid displacement machine in accordance with the invention in which the shoe is fixed and joined to the frame.

FIG. 1 shows a scroll type fluid displacement machine in accordance with the invention. A machine of this kind is particularly well suited for use as a vacuum pump but can also be used as a compressor or to pump a liquid.

It comprises a fixed frame 1 in two parts assembled together: a body 1A and a casing 1B. The frame encloses all of the machine and in particular its active pumping parts comprising a fixed disk 2 conventionally including a spiral working wall 3 and a mobile disk 4 also including a spiral working wall 5 cooperating with that of the fixed disk. With their disk, these two spirals delimit a working volume 6.

On the side opposite the mobile disk 4 the fixed disk 2 is joined to the frame 1 by a fixed central shaft 7. The central shaft 7 is hollow and therefore comprises a passage 8 constituting a discharge passage connected to a discharge outlet 9.

Beyond the spiral wall 5 and around the fixed disk 2 the periphery of the mobile disk 4 is joined to the periphery of a coupling flange 10. With the mobile disk 4 the coupling flange 10 constitutes a fluid-tight casing enclosing the fixed disk 2. The central part of the flange 10 is open and the fixed central shaft 7 passes through it. This central part of the flange is fixed and sealed to an eccentric hollow shaft 11 and to one end of a sealing bellows 12 the other end of which is fixed to the frame 1 at the end of the fixed central shaft 7. The bellows 12 surrounds the fixed central shaft 7.

The space 13 between the sealing bellows 12 and the fixed central shaft 7 constitutes a suction passage connected to a suction inlet 14.

The eccentric hollow shaft 11 is journaled in a bore 15 in a main rotary shaft 16 having an axis 17. The axis 18 of the bore 15 is eccentric to the rotation axis 17 of the main rotary shaft 16. Accordingly, rotation of the main rotary shaft 16, associated with any type of anti-rotation means, causes circular translation movement without rotation of the eccentric shaft 11 and the components attached to it: the coupling flange 10 and the mobile disk 4.

In the example described, an Oldham joint 19 prevents angular rotation of the mobile disk 4. The main rotary shaft 16 is hollow and surrounds the sealing bellows 10. It is supported in the frame 1 by bearings 20, 21.

Rotation of the main rotary shaft 16 is driven by an electric motor the rotor 22 of which is attached to the shaft 16 and separated from the stator 23 by a tubular sealing jacket 24. The mobile disk 4 is precisely positioned in the axial direction by a system including a shoe 25 rubbing between two lateral abutments 26, 27. In the FIG. 1 example the shoe 25 forms a fixed circular ring joined to the frame 1 between the parts 1A and 1B and the lateral abutments 26 and 27 are respectively part of the connecting flange 1 and the mobile disk 4. The lateral abutments 26 and 27 form two rings projecting outwardly of the internal volume of the mobile casing consisting of the flange 10 and the mobile disk 4 joined together by screws 28 with a spacer 29 and gaskets 30 and 31 between them.

The thickness of the spacer 29 corresponds to that of the shoe 25, ignoring the clearance required for rubbing between the shoe 25 and the lateral abutments 26 and 27.

The axial position of the mobile disk 4, and therefore the clearance between the respective disks 2 an 4 and the end of the spiral walls 3 and 5, is precisely adjusted by choosing the spacer 29 and the shoe 25.

All of the fluid circuit from the suction inlet 14 to the discharge outlet 9 is clearly completely isolated from and sealed with respect to all mechanical parts such as the bearings 20, 21, the shoe type axial positioning device 25, 26, 27 external to the casing 4–10 and the eccentric shaft 11 journaled in the eccentric bore 15.

A machine of this kind is therefore perfectly suited to use as a clean and dry vacuum pump.

The mechanical parts referred to above external to the fluid circuit isolated by the bellows 10 and the fluid-tight casing 4–10 are lubricated.

Figure 2:
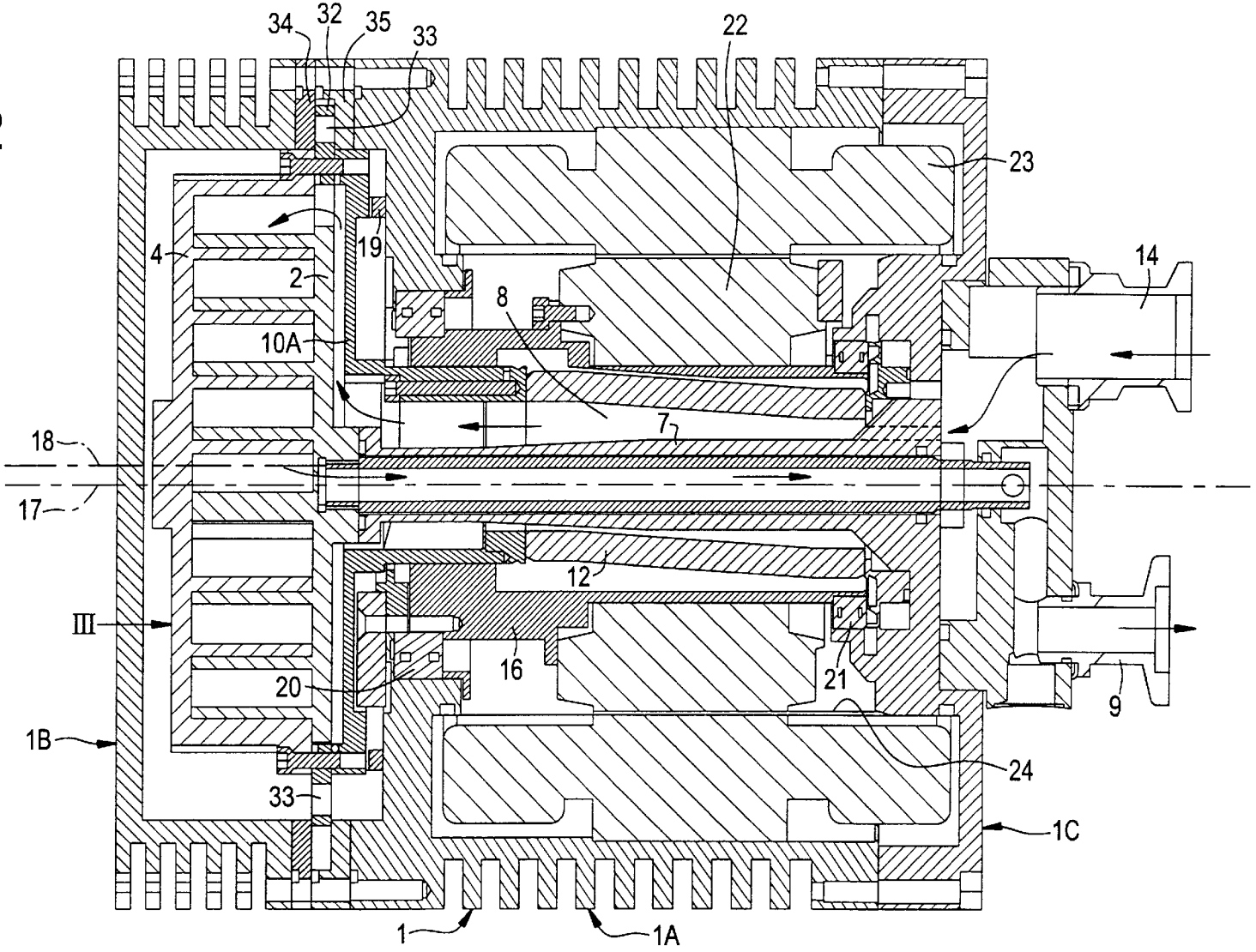
FIG. 2 is a variant of FIG. 1 in which the shoe is mobile and joined to the mobile disk and the shoe and the lateral abutments are in the form of washer-disks.

FIG. 2 shows a variant in which axial positioning of the mobile disk 4 by means of a shoe rubbing between two lateral abutments is effected by a mobile shoe 32 joined to the casing 4–10A. The shoe is in the form of a washer-disk with oil holes 33 and rubs between two fixed lateral abutments joined to the frame 1: an abutment 34 and an abutment-spacer 35. The axial position of the mobile disk 4 is precisely adjusted by choosing the abutment-spacer 35. The abutment 34 and the abutment-spacer 35 are also disk shape.

In this figure the device for preventing rotation of the mobile disk 4 by means of an Oldham joint 19 is between the coupling flange 10A and the frame 1A, rather than between the disk 4 and the frame 1B, as in FIG. 1. This new arrangement provides immediate access to the mobile disk 4 without removing anything other than the part 1B of the frame 1. In this figure the frame is in three parts 1A, 1B and 1C.

Another modification in FIG. 2 is that the connecting flange 10A and the eccentric shaft 11 are in one piece.

The figure also shows other modifications but these are not relevant to the present invention.

FIGS. 3, 4 and 5 show another variant of the axial positioning system. In this variant the shoe is joined to the mobile part 4–10A as in FIG. 2. The only differences lie in the shape of the shoe and in the construction of the lateral abutments joined to the frame 1.

FIG. 3 is an end view of the machine as seen from the lefthand side in FIG. 2 with the part 1B of the frame removed and, of course, with the shoe and the lateral abutments corresponding to the new variant.

In this variant, the mobile shoe 36 is in the form of a washer-disk having a circular internal perimeter 37 but whose external perimeter comprises four protuberances 38 at 90° forming rubbing members each sandwiched between two lateral abutments 39 and the spacer-abutment 40. Here the lateral abutments 39 and the spacer-abutments 40 are in the form of strips. Two abutments 39 and 40 are fixed to the part 1A of the frame by two screws 41 with the two spacers separated by means of two small tubes 42 through which the screws 41 pass and the thickness of which corresponds to the thickness of the protuberances 38 on the shoe 36, ignoring the clearance necessary for free rubbing.

The axial position of the mobile disk 4 is precisely adjusted by choosing the thickness of the spacer-abutments 40.

In the lower part of FIG. 3 the lateral abutments 39 and the spacer-abutments 40 have been omitted in order to show clearly two protuberances 38 on the shoe 36.

In FIG. 4 the shoe 36 is a separate part, independent of the mobile disk 4 and the connecting flange 10A. The shoe can be integrated with the connecting flange 10A or with the mobile disk 4, however.

In the machine of the invention the shoe is outside the diameter of the fixed disk 2 and the mobile disk 4 and therefore has a large diameter which facilitates the parallelism of the two disks, which is not the case in the cited prior art document.

We claim:

1. Scroll type fluid displacement machine including a fixed disk (2) comprising a spiral working wall (3), a mobile disk (4) also comprising a spiral working wall (5) cooperating with that of the fixed disk and means (11, 16, 22, 23) for driving circular translation movement of the mobile disk, the mobile disk being positioned axially by a system including a shoe (25, 32, 36) rubbing between two lateral abutments (26, 27–34 35–39, 40), one member of the pair of members including the shoe or the lateral abutments, being attached to a fixed frame (1) and the other member of this pair of members being fastened to said mobile disk (4), characterized in that the fixed disk (2) is joined on the side opposite the mobile disk (4) to a fixed central shaft (7) joined to the frame (1) and including a discharge passage (8), said central shaft (7) being surrounded by a sealing bellows (12) connected at one end to the frame and at its other end to a connecting flange (10, 10A) the periphery of which, around the fixed disk (2), is joined to the mobile disk (4) beyond its spiral wall (5), the mobile disk (4) and the flange (10, 10A) forming a casing enclosing the fixed disk (2), the space (13) between the bellows (12) and said central shaft (7) constituting a suction passage, and in that said mobile disk axial positioning system is external of the internal volume of said casing (4–10, 10A), said other member attached to the mobile disk being attached to said casing and projecting externally of it.

* * * * *